United States Patent [19]

Blume et al.

[11] 4,026,438

[45] May 31, 1977

[54] DEVICE FOR APPLYING PRESSURE TO STACKED ARTICLES

[75] Inventors: Erich Blume, Wiesbaden-Biebrich; Eberhard Schörnig, Taunusstein-Orlen, both of Germany

[73] Assignee: Hoechst Aktiengesellschaft, Frankfurt am Main, Germany

[22] Filed: July 9, 1975

[21] Appl. No.: 594,445

[30] Foreign Application Priority Data

July 15, 1974 Germany ..... 2433881

[52] U.S. Cl. ..... 221/231; 271/149

[51] Int. Cl.[2] ..... B65G 59/00

[58] Field of Search ..... 221/226, 227, 230, 231, 221/232, 279; 271/149, 150, 126, 129

[56] References Cited

UNITED STATES PATENTS

| | | | |
|---|---|---|---|
| 831,851 | 9/1906 | Frain | 221/232 |
| 1,997,080 | 4/1935 | Reimers et al. | 221/232 X |
| 3,035,834 | 5/1962 | Bottrell | 271/149 X |
| 3,062,407 | 11/1962 | Cordis | 221/230 X |
| 3,391,827 | 7/1968 | Govatsos | 221/226 X |

*Primary Examiner*—Stanley H. Tollberg
*Attorney, Agent, or Firm*—Richard L. Schwaab

[57] ABSTRACT

A device for applying pressure to a stack of flat items such as sheets, cards, plates or the like, which device is primarily intended for use in an apparatus which feeds items from the stack for further processing. The device provides a constant pressure on the stack, regardless of whether the stack is in full or depleted condition, and, in this way, the device substantially reduces the possibility of malfunctioning by way of two items being fed at once. The device includes a slide member which is linearly movable in a housing, a main weight movable with respect to the slide member, and a roller. The slide member, main weight and roller are operatively coupled together so that the slide member will be urged in the feeding direction under constant force.

7 Claims, 3 Drawing Figures

DEVICE FOR APPLYING PRESSURE TO STACKED ARTICLES

BACKGROUND

1. Field of the Invention

Figure 1:
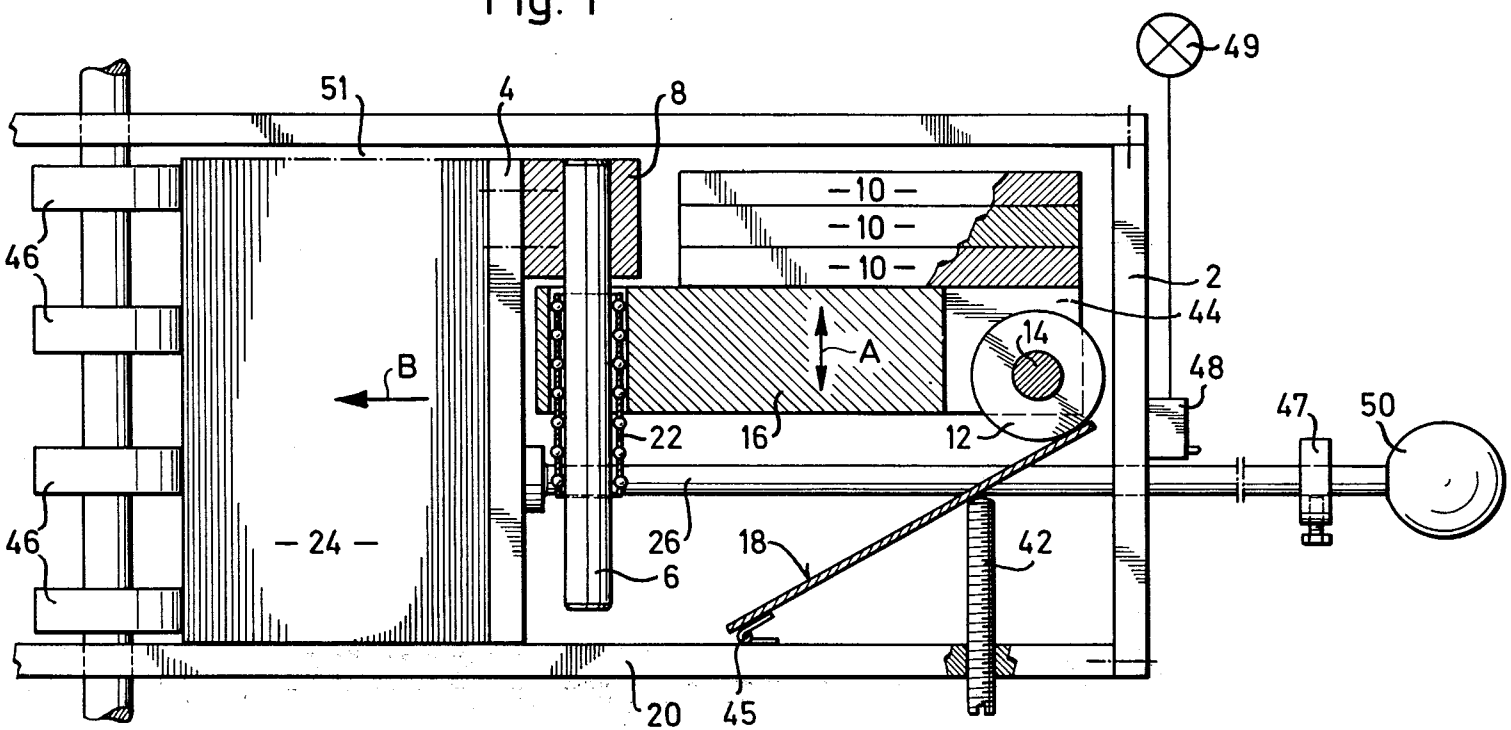

This invention relates to a device for applying pressure to stacked sheets, cards, plates or like materials which are to be individually drawn off from a stack. Such a device is a constituent of a sheet feeding apparatus which is used particularly in copying machines and reenlargement appartus. Also, such sheet feeding apparatus is used particularly in electronic processors in which copying material in the form of sheets, cards, or finished data carriers, such as punched cards, are individually fed from the stack to the machine for further processing. Furthermore, in the field of microfilm application as well as in the reading or duplicating of punched cards for electronic computers, vertical stack arrangements are used often today for handling material to be fed to the machine.

2. Description of the Prior Art

In a known feeding device, the sheet or card stack is moved vertically upward by means of a slide actuated by a motor via a transmission system. Use of a motor and transmission, makes such a device expensive in its construction and also susceptible to trouble because of the electromotor.

Another known device for issuing individually succeeding cards from one end of a card stack has a load member upon which acts a counterholding device in order to permit only one movement of the load member to that end of the stack from which the cards are issued. The counterholding device substantially prevents movement of the load member in the opposite direction. The counterholding device is provided with two leaf springs which are carried by the load member and extend obliquely to the lateral surfaces of the magazine for the reception of the stack. It is again a vertical stack of which the lowermost card to be drawn off by an issuing mechanism is constantly loaded with a pressure resulting from the sum of the stacked cards arranged thereupon and the weight of the load member. It can be seen that the contact pressure on the card to be issued is not constant but depends on the height of the card stack.

An essential criterion for perfect operation of an issuing mechanism of a sheet feeding device is that a constant contact pressure is exerted upon the first as well as upon the last card to be drawn off from the stack. This is particularly necessary with high-speed machines in which drawing off of the sheets or cards is performed continuously by means of friction rolls. In the case of fluctuations of the contact pressure, double introductions easily occur. That means that two or more cards, sheets, microfilms or plates are drawn off simultaneously. Such simultaneous multiple feeding actuates control devices of the machine which, in turn, actuate a trouble indicator, bringing the machine to a standstill. In the case of machines without co-ordinated devices for indicating trouble and stopping the machine, simultaneous withdrawal of two or more sheets, microfilms or the like generally leads to undersirable incorrect exposures. Another disadvantage is that the drawn-off material, in the case of double introduction, is generally more or less damaged, which requires manual removal thereof from the travel path to ensure perfect operation of the machine. This generally also requires stopping of the machine.

In the case of vertical stacking, a constant contact pressure is generally achieved by loading the stack with a corresponding weight. Despite this measure, the contact pressure is different for the individual cards or sheets of the stack since, between the first and the last fed card, the contact pressure is reduced by the deviation of the stack weight resulting from the differing height of the stack.

In the case of horizontal stacking, the contact pressure is achieved by springs resting with one end upon the rear side of a slide member and with the other end upon a back wall of the device. The springs must have a spring characteristic as flat as possible but, despite various different arrangements and combinations for achieving a flat spring characteristic, there is still a considerable pressure difference of the order of a few kilograms as the stack becomes depleted. Another disadvantage is that the flat spring characteristic requires a considerable spring length, so that much space is required for horizontal stacking of the material to be stacked. Tests have been made to compensate for the great difference of the contact pressure between the first and the last stack feedings by a very exact adjustment of the spring tension, but it has been shown that, despite the high expenditure for exact adjustment of the spring tension, double introductions and the difficulties attendant thereto can be successfully prevented only in the medium adjustment range of the springs but not for the marginal ranges of the spring characteristic.

SUMMARY OF THE INVENTION

It is therefore an object of the invention to provide a device applying pressure to a horizontally arranged stack, with which device a constant contact pressure is exerted on the stacked material independently of the size of the stack, and which device requires little space, can be adjusted quickly, and is of a simple construction.

This object is achieved by the device of the present invention which includes a slide member for feeding of the stack and a vertically movable, main weight which imparts a constant contact pressure to the slide member and against the stack over the entire feed path, the main weight being connected with a roller. Additional weights, which can be joined with the main weight, are advantageously provided for increasing the contact pressure against the stack. In one embodiment, the main weight is advantageously coupled with the slide member by a bearing having a vertically disposed axis and providing a connection which is free from play, so that the main weight can be moved up and down. The slide member has a bearing block which receives one end of a vertically extending shaft passing through the bearing. The roller is arranged by means of an axle in a slot of the main weight, the weight being arranged in the housing of the pressure device.

A preferred embodiment provides an inclined plane on which the roller rolls up or down. The inclined plane is supported on the base plate of the pressure device, and its inclination with respect to the horizontal can be adjusted by means of an adjusting member. The adjusting member advantageously is a setscrew.

As a result of using the inclined plane, the main weight moves vertically with the roller as it rolls along the inclined plane, and the weight is resolved into a parallelogram of forces with a horizontal and a vertical component. The horizontal component is constant because of the constant inclination of the inclined plane, and this component of weight exerts the desired uniform pressure upon the slide which moves the stacked material to be fed. To facilitate movement of the slide member in the feeding direction, there is advantageously provided a guide member which passes through the back wall of the pressure device.

The housing defines an interior space in which the slide member is disposed, and, in another embodiment of the invention, the main weight is arranged outside the interior space of the housing of the pressure device. By way of a cable passing through the housing wall, the weight is connected with the roller which is arranged in the housing by means of an axle extending transversely to the feeding direction of the slide member. The cable is mounted to a cable holder, including means for releasably fixing the holder to the guide member so that the holder may be adjusted to various positions along the guide member.

The invention provides clear advantages in that the contact pressure on the drawoff rolls for drawing off the stacked material is equal from the first to the last sheet and that, by the arrangement of the weight in the one embodiment directly behind the dead position of the slide, very little space is required for the maximum stack to be accommodated. When the required weight is once determined and the inclination of the inclined plane adjusted, further adjusting and mounting work is not necessary even if the drawoff roll or rolls is or are considerably worn. It is thus possible in a very simple manner to prevent double introduction of stacked material, which increases the efficiency of the sheet feeding device and thus that of the entire machine, since the down time caused by mechanical difficulties is greatly reduced. A further advantage is that damage to the stacked material to be fed does not occur in most cases and replacement of the damaged originals is therefore not necessary. Additional cost and working time are thus avoided.

Figure 1A:
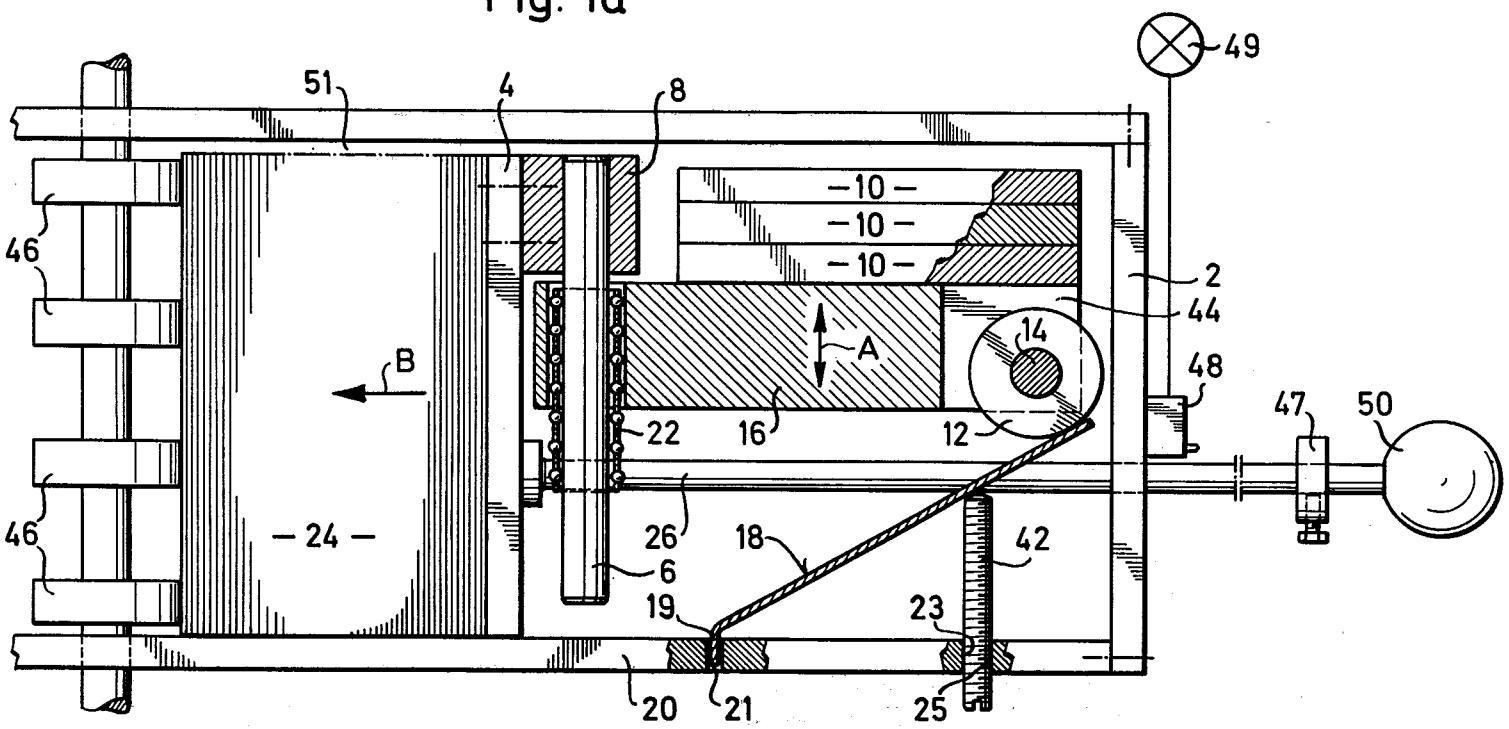
Figure 2:
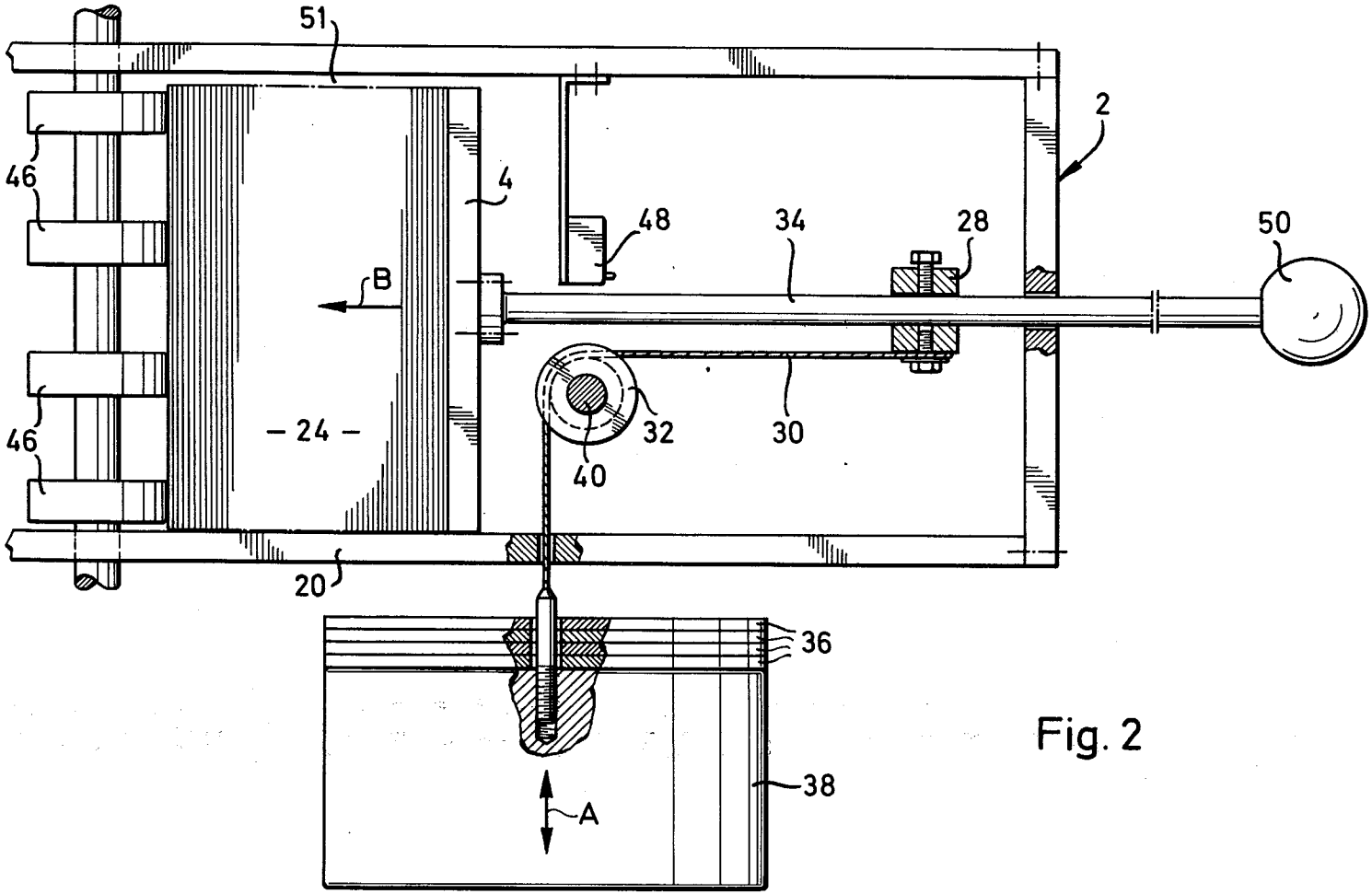

DRAWINGS:

The invention will now be further illustrated by means of exemplary embodiments shown in the accompanying drawings, of which:

FIG. 1 is a side elevation, partly in section, of one embodiment of the pressure device;

FIG. 1*a* shows a detail of the support of an inclined plane of the pressure device; and FIG. 2 is a side elevation, partly in section, of another embodiment of the pressure device.

DESCRIPTION

A slide member 4 which rests upon a back wall of a stack 24 is arranged in a housing 2. The stack may consist, for example, of punched cards, aperture cards, sheets, plates, microfilms or like material. The slide 4 is moved in the direction of the arrow B by means of a guide member 26. On the rear side of slide member 4, there is mounted a bearing block 8 which receives a vertically extending shaft 6 for a main weight 16. The shaft 6 passes through an elongated bearing 22 adapted to accommodate movement in the axial direction. Bearing 22 is disposed in the weight 16 which can be moved up and down in the two directions indicated by the double arrow A. Additional weights 10 can be placed onto the main weight 16 to optionally increase the contact pressure exerted by weight 16 upon the slide member 4.

The weight 16 is so mounted that it can be moved up and down with respect to the slide member 4 by means of the elongated bearing 22, which is free from play, and by means of the hardened shaft 6 and the bearing block 8. A roller 12 is arranged by means of an axle 14 in a slot 44 of the main weight 16. The main weight 16 is arranged within the housing 2 of the pressure device and can be adjusted vertically and horizontally by means of the roller 12 arranged in the slot 44 and capable of rolling up and down on an inclined plane 18. The inclined plane 18 consists, for example, of a stiffened metal sheet which is supported on the base plate 20 of the pressure device, e.g. by means of a hinge 45, and which further rests upon an adjusting member 42 passing through the base plate 20. The bent end 18' of the inclined plane may also be supported in the base plate 20 in a blind hole or in a bore 20', as shown in FIG. 1*a*. The adjusting member 42 may, for example, be a setscrew which engages a thread 25 in a bore 23 of the base plate 20. By rotating the setscrew, the inclination of the inclined plane may be changed with respect to the horizontal. Another possibility for changing the inclination of the plane 18 is to push a wedge of a predetermined size through the back wall of the housing 2 of the pressure device via a slot (not illustrated), which wedge can be fixed on the inclined plane.

The inclined plane 18 causes a resolution of forces of the main weight 16 and the additional weights 10 optionally connected therewith so that a horizontal component and a vertical component are obtained. The horizontal component of the parallelogram of forces yields a constant contact pressure against the slide member 4, which pressure is transferred via the shaft 6 and the bearing block 8 to the slide 4. This constant contact pressure is exerted upon the stack 24 via the slide member 4 in the direction of arrow B. The stack material is thus always pressed with the same contact force onto the drawoff rolls 46 and thus is drawn off with the same frictional force so that double removal due to fluctuating contact pressure is avoided. Drawing off of the last piece of the stacked material usually is indicated by a microswitch 48 and a setting ring 47 which actuates a signal lamp 49 so that, in such instance, the operator can withdraw the slide member 4 by means of a handle 50 in a direction opposite to the direction of the arrow B, to insert a new stack 24 into the pressure device. During withdrawing, the main weight 16 is lifted by the inclined plane 18. The potential energy of the main weight 16 is thus stored, and the weight presses the slide against the newly inserted stack 24 in the above-described manner.

In the embodiment shown in FIG. 2, a main weight 38 is arranged outside the housing of the pressure device. Additional weights 36 may be connected with the main weight 38 to increase the contact pressure exerted on the slide member 4. By way of a cable 30 passing through an aperture in the base plate 20 of the pressure device, the weight 38, or the combination of the weight 38 and the additional weights 36, is connected with a roller 32 arranged in the housing 2 with an axle 40. The end of the cable is mounted on a cable holder 28 which can be fixed and adjusted along a guide member 34 for the slide member 4. By the main weight 38 alone or in combination with the additional weights 36, a vertical traction is exerted on the cable 30 which is converted into a horizontal traction by means of the roller 32. The direction of traction is in the direction of the arrow B and is transferred via guide member 34 to the slide member 4 which thereby always receives a constant pressure against the drawoff rolls 46 independently of the thickness of the stack. The sheets, cards, microfilms or the like materials arranged transversely in the stack, of which the transverse edges can be seen in FIG. 1 as well as in FIG. 2, are drawn off laterally, i.e., perpendicularly to the plane of view, for example. The stack 24 as well as the slide member 4 do not extend entirely from the bottom to the top of the housing of the pressure device but have a gap 51 with respect to the cover plate of the housing 2, which gap serves to prevent blocking of the stacked materials in the housing. Without the gap, such blocking might occur, for example, by an incorrect positioning of the individual sheets, cards or other materials of the stack 24.

Although certain embodiments of the present invention have been illustrated herein, many modifications and variations will be apparent to one skilled in the art. It is therefore to be understood that within the scope of the appended claims the invention may be practiced otherwise than as specifically described.

What is claimed is:

1. A device for applying pressure to a stack of flat items to be individually drawn off from the stack, the device comprising: a housing adapted to receive the stack of flat items; a slide member disposed in said housing for horizontal, linear movement therewithin to impart a constant pressure against the stack regardless of the number of items in the stack; a main weight which is movable with respect to said slide member; a roller; said slide member, said main weight, and said roller being operatively coupled together; a bearing between said slide member and said main weight, said bearing having a vertically disposed axis, said bearing providing a connection between said slide member and said main weight, which connection is free from play and which, in part, defines a path of vertical movement of said weight.

2. A device as defined in claim 2, including a bearing block on said slide member and a vertically extending shaft, one end of which is mounted in said bearing block, said shaft extending through said bearing in axially slidable engagement therewith.

3. A device as defined in claim 1, including a base plate in a housing and an inclined plane on said base plate, said roller being rotatable about an axle, said axle being disposed in said main weight and extending across a slot in said main weight, said roller engaging said inclined plane for rolling movement therealong.

4. A device as defined in claim 1 wherein said housing includes a rear wall, and wherein a guide member passes through said rear wall and is coupled to said slide member to guide the movement of said slide member in the feeding direction.

5. A device as defined in claim 1, wherein said housing includes an adjusting member coupled thereto and to said inclined plane for adjusting the inclination thereof.

6. A device as defined in claim 5, wherein said adjusting member is a setscrew.

7. A device for applying pressure to a stack of flat items to be individually drawn off from the stack, the device comprising: a housing adapted to receive the stack of flat items; an inclined plane in said housing; a slide member disposed in said housing for linear movement therewithin to impart a constant pressure against the stack regardless of the number of items in the stack; a main weight which is movable relative to said slide member while pressure is applied to the stack; a roller; said slide member, said main weight, and said roller being operatively coupled together; said main weight including a slot therein; said roller being rotatable about an axle, said axle being disposed in said main weight and extending across the slot, said roller engaging said inclined plane for rolling movement therealong.

* * * * *

UNITED STATES PATENT AND TRADEMARK OFFICE

CERTIFICATE OF CORRECTION

PATENT NO. : 4,026,438

DATED : May 31, 1977

INVENTOR(S) : ERICH BLUME et al.

It is certified that error appears in the above-identified patent and that said Letters Patent are hereby corrected as shown below:

Column 1, line 12, "appartus" should be --apparatus--.

Claim 2, line 1, after "Claim", "2" should be --1--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*